US008733054B2

(12) United States Patent
Schröer et al.

(10) Patent No.: US 8,733,054 B2
(45) Date of Patent: May 27, 2014

(54) METHOD FOR PRODUCING A FUNCTIONAL LAYER OF A BUILDING SHELL, AND BUILDING SHELL AND FUNCTIONAL LAYER

(71) Applicant: Ewald Dörken AG, Herdecke (DE)

(72) Inventors: Jörn Schröer, Herdecke (DE); Jochen Lipps, Hagen (DE); Georg Meyer, Solingen (DE)

(73) Assignee: Ewald Doerken AG, Herdecke (DE)

( * ) Notice: Subject to any disclaimer, the term of this patent is extended or adjusted under 35 U.S.C. 154(b) by 0 days.

(21) Appl. No.: 13/953,941

(22) Filed: Jul. 30, 2013

(65) Prior Publication Data

US 2013/0333315 A1 Dec. 19, 2013

Related U.S. Application Data

(62) Division of application No. 13/260,764, filed as application No. PCT/EP2010/001867 on Mar. 25, 2010.

(30) Foreign Application Priority Data

| | | |
|---|---|---|
| Mar. 28, 2009 | (DE) | 10 2009 015 473 |
| Jul. 2, 2009 | (DE) | 10 2009 033 005 |
| Oct. 13, 2009 | (DE) | 10 2009 049 284 |
| Oct. 13, 2009 | (DE) | 10 2009 049 352 |

(51) Int. Cl.
*E04B 1/62* (2006.01)

(52) U.S. Cl.
USPC ..... 52/515; 52/412; 52/741.4; 52/746.11

(58) Field of Classification Search
USPC ..... 52/408, 412, 514–517, 741.3, 741.4, 52/742.12, 742.13, 746.11
See application file for complete search history.

(56) References Cited

U.S. PATENT DOCUMENTS

| | | | |
|---|---|---|---|
| 2,003,503 | A | 6/1935 | Eason |
| 2,179,678 | A | 11/1939 | Wenzel |

(Continued)

FOREIGN PATENT DOCUMENTS

| | | | |
|---|---|---|---|
| DE | 201 20 812 U1 | | 4/2003 |
| DE | 20120812 | * | 4/2003 |

(Continued)

OTHER PUBLICATIONS

Definition of "edge" https://www.google.com/search?q=defin+edge &aq=f&oq=define+edge&aqs=chrome.057j013.3383 &sugexp=chrome, mod=0&s ourceid=chrome&ie=UTF-8.

*Primary Examiner* — Adriana Figueroa
(74) *Attorney, Agent, or Firm* — Roberts Mlotkowski Safran & Cole, P.C.; David S. Safran

(57) ABSTRACT

A functional layer for a building shell, a method for production of the functional layer, and a building shell with the functional layer applied thereto. The building shell has a sheathing on its inside and a large number of rafters with roof bays provided between the rafters and the sheathing. The functional layer is applied at least in some places by painting and/or spraying on the outside of the sheathing, and an air-tight and/or water-tight foil, made especially as a vapor barrier, forms after application.

6 Claims, 12 Drawing Sheets

(56) References Cited

U.S. PATENT DOCUMENTS

| | | | | | |
|---|---|---|---|---|---|
| 3,210,902 | A | | 10/1965 | Craig | |
| 3,215,243 | A | | 11/1965 | Dickerson | |
| 3,302,362 | A | * | 2/1967 | Lang | 52/742.13 |
| 3,698,972 | A | * | 10/1972 | Lenzner | 156/71 |
| 3,996,396 | A | | 12/1976 | Hansen et al. | |
| 4,236,951 | A | | 12/1980 | Krchma et al. | |
| 4,471,591 | A | | 9/1984 | Jamison | |
| 4,843,774 | A | | 7/1989 | Korsgaard | |
| 5,389,167 | A | | 2/1995 | Sperber | |
| 5,447,006 | A | | 9/1995 | Zenor | |
| 5,593,771 | A | | 1/1997 | Lawless et al. | |
| 5,819,496 | A | | 10/1998 | Sperber | |
| 5,950,383 | A | * | 9/1999 | Williamson et al. | 52/408 |
| 7,955,658 | B2 | * | 6/2011 | Grasse et al. | 427/385.5 |
| 2003/0215609 | A1 | * | 11/2003 | Burkart | 428/141 |
| 2004/0103604 | A1 | | 6/2004 | Kunzel et al. | |
| 2007/0141308 | A1 | | 6/2007 | Studer | |
| 2009/0301016 | A1 | * | 12/2009 | Schroer et al. | 52/408 |
| 2010/0064602 | A1 | | 3/2010 | Moore | |

FOREIGN PATENT DOCUMENTS

| | | | | |
|---|---|---|---|---|
| EP | 0 185 214 | A1 | | 6/1986 |
| EP | 1 362 694 | A1 | | 11/2003 |
| WO | WO 2007054148 | A1 | * | 5/2007 |

* cited by examiner

Table 1a

| | Measuring Unit | Sample | | | | |
|---|---|---|---|---|---|---|
| | | 1 | 2 | 3 | 4 | 5 |
| Diameter | mm | 138 | 138 | 138 | 138 | 138 |
| Diameter of the Free Test Surface | mm | 127 | 127 | 127 | 127 | 127 |
| Thickness | mm | 0.09 | 0.08 | 0.09 | 0.09 | 0.09 |
| Test Surface | $cm^2$ | 127 | 127 | 127 | 137 | 137 |
| Surface Mass | $kg/m^2$ | 0.10 | 0.10 | 0.10 | 0.10 | 0.11 |

Fig. 21

Table 1b

| | Measuring Unit | Sample | | | | |
|---|---|---|---|---|---|---|
| | | 1 | 2 | 3 | 4 | 5 |
| Diameter | mm | 138 | 138 | 138 | 138 | 138 |
| Diameter of the Free Test Surface | mm | 127 | 127 | 127 | 127 | 127 |
| Thickness | mm | 0.10 | 0.09 | 0.10 | 0.09 | 0.10 |
| Test Surface | $cm^2$ | 127 | 127 | 127 | 137 | 137 |
| Surface Mass | $kg/m^2$ | 0.11 | 0.10 | 0.11 | 0.10 | 0.11 |

Fig. 22

Table 2a

| Sample Number | Water Vapor Diffusion Flow Density $g$ [kg/(m² · s)] | Water Vapor Diffusion Permeability Coefficient $W$ [kg/(m² · s · Pa)] | Water Vapor Diffusion Leading Coefficient $\delta$ [kg/(m · s · Pa)] | Water Vapor Diffusion Equivalent Air Layer Thickness $s_d$ [m] | Water Vapor Diffusion Resistance Number $\mu$ [-] |
|---|---|---|---|---|---|
| 1 | 1.79E-06 | 1.41E-09 | 1.32E-13 | 0.141 | 1509.8 |
| 2 | 1.75E-06 | 1.38E-09 | 1.15E-13 | 0.144 | 1730.6 |
| 3 | 1.78E-06 | 1.40E-09 | 1.31E-13 | 0.142 | 1523.9 |
| 4 | 2.60E-06 | 2.05E-09 | 1.78E-13 | 0.098 | 1134.7 |
| 5 | 1.95E-06 | 1.54E-09 | 1.43E-13 | 0.130 | 1390.4 |
| **Mean Value** | **1.8E-06** | **1.4E-09** | **1.3E-13** | **0.14** | **1600** |

Fig. 23

Table 2b

| Sample Number | Water Vapor Diffusion Flow Density $g$ [kg/(m² · s)] | Water Vapor Diffusion Permeability Coefficient $W$ [kg/(m² · s · Pa)] | Water Vapor Diffusion Leading Coefficient $\delta$ [kg/(m · s · Pa)] | Water Vapor Diffusion Equivalent Air Layer Thickness $s_d$ [m] | Water Vapor Diffusion Resistance Number $\mu$ [-] |
|---|---|---|---|---|---|
| 1 | 1.05E-06 | 7.53E-10 | 7.79E-14 | 0.264 | 2560 |
| 2 | 1.14E-06 | 8.18E-10 | 7.64E-14 | 0.243 | 2610 |
| 3 | 1.04E-06 | 7.42E-10 | 7.17E-14 | 0.268 | 2780 |
| 4 | 1.10E-06 | 7.88E-10 | 7.09E-14 | 0.253 | 2810 |
| 5 | 1.11E-06 | 7.92E-10 | 7.65E-14 | 0.251 | 2600 |
| **Mean Value** | **1.1E-06** | **7.8E-10** | **7.5E-14** | **0.26** | **2700** |

Fig. 24

METHOD FOR PRODUCING A FUNCTIONAL LAYER OF A BUILDING SHELL, AND BUILDING SHELL AND FUNCTIONAL LAYER

CROSS REFERENCE TO RELATED APPLICATION

This application is a divisional of co-pending U.S. patent application Ser. No. 13/260,764.

BACKGROUND OF THE INVENTION

1. Field of the Invention

The invention relates to a method for producing a functional layer of a building shell. In addition, this invention relates to a functional shell, produced, in particular, according to the above-mentioned method, as well as a functional layer produced, in particular, according to the above-mentioned method.

2. Description of Related Art

These days, high requirements are set for roofs and façades, i.e., the building shell, because of internal and external factors. External factors are water in liquid form (rain, light snow, melt water, etc.), but also dust, dirt and insects, which penetrate or are driven in through cuts and joints in the cover material. As a result, the subjacent layers can become unacceptably soaked, soiled and/or damaged. Internal factors are, e.g., water vapor convection or diffusion, which can result in unacceptably high levels of melt water or condensation water formation.

To protect the overall structure from the above-mentioned factors, structural composite foils are now installed. For protection from external factors, in general sarking (a layer of boards or bituminous felt placed beneath tiles or other roofing to provide thermal insulation or to prevent ingress of water), below-deck and façade membranes are used; for protection against internal factors, air and vapor traps/barriers are used. Depending on climatic conditions, in this connection the inverse arrangement can also be useful. Depending on the material of the structural composite foils that is used, different properties are necessary, e.g., the water-tightness and the water vapor permeability (sd value), whereby depending on the requirement, a distinction is made among membranes that are open to diffusion (sd value of between 0 and 0.5 m), moisture-variable, vapor-barrier membranes (sd value of between 0.5 and 1,500 m), and vapor-trapping membranes (sd value >1,500 m) (DIN 4108).

In terms of shape, slope, configuration and exposure, roofs are distinguished by, e.g., use, construction, climatic conditions and exposure with respect to building physics. While undisturbed surfaces can be relatively easily covered, there are detail points, e.g., cullises, collars, rising components and connections, as well as intersections, e.g., aerators, cables, etc., to which time-consuming and material-intensive connections have to be made. Also, when installing a structural composite foil, damages of the functional layer by mechanical, chemical and physical stresses can occur. Altogether, it is thus difficult to produce the necessary water-tightness and air-tightness of the structural composite foil.

Previously, connections, detail points, and damage to the functional layer were fixed or repaired by collars or adhesive tapes. The disadvantage of this method is that structural composite foils can be matched to or connected in a time-consuming and difficult way with aids, e.g., nails, staples, adhesive tapes, e.g., with geometrically demanding and/or poorly available details. In addition, in particular, adhesive tapes do not adhere to moist or dusty bases, which are frequently encountered in restoration.

Special difficulties arise even when installing a functional layer in the region of the roof squares. This relates both to the first production of a roof in new construction and roof repair or renovation. The roof squares are formed here by the free spaces between the rafters, whereby a sheathing is provided on the inside of the building, i.e., in the building. The arrangement of a structural composite foil in the roof square and the connection to the sheathing is often difficult and time-consuming.

SUMMARY OF THE INVENTION

The object of this invention is to make available a method and a building shell of the above-mentioned type, whereby a functional layer can also be applied in a simple way in a roof square.

Another object of this invention is to make available a functional layer for a building shell or a method for the production of a functional layer, whereby in a simple way, a matching of the functional layer to specific details of the building shell is possible, and at the same time the necessary sealing of the functional layer is ensured.

In a method of the above-mentioned type, the above-mentioned object is achieved according to the invention in that the functional layer is applied at least in some places by painting or spraying on the outside of the sheathing, and an air-tight and/or water-tight foil that is designed, in particular, as a vapor barrier that forms after application.

The above-mentioned object is achieved with a functional layer of a building shell according to the invention, in that the functional layer has a foil that is applied by spraying and/or painting at least in some places, which forms an air-tight and/or water-tight film after application. In this case, in addition to the foil, at least one structural composite foil can preferably be provided. In this case, the foil is preferably applied in places in which no structural composite foil is provided and/or the structural composite foil is damaged and/or slashed or cut out.

As a result, a method is provided by the invention, with which it is possible, in a simple way, to apply a tight functional layer quickly and without damage to the outside of a sheathing that forms the bottom or base of a roof square and that, moreover, meets all construction requirements. Moreover, the invention thus provides a material or a method, whereby—regardless of the composition of the base and the type of geometric requirement—the detail of the building or the building shell in question can be equipped quickly and easily with a functional layer, which meets all construction requirements. The foil that is applied by spraying and/or painting, which is referred to below as "spray foil" for the sake of simplicity, but is not limited to spraying, but rather can also be painted, offers the significant advantage that it can be applied very much faster and easier than a structural composite foil that is inserted into the roof square that can optionally be assigned to, and moreover, fastened there accordingly. In this case, the spray foil is preferably applied as the inner or bottommost layer, i.e., indirectly or directly, on the external roof system. By a corresponding selection of material of the spray foil, it can be ensured that the latter adheres securely to the outside of the sheathing, i.e., special fastening means are not necessary.

According to the invention, it is possible, in principle, that the functional layer is formed completely from the spray foil. In this connection, however, this is rather a special case, which can occur in particular in very rambling roofs, in which installation of structural composite foils is difficult. It is preferred when the functional layer—as follow-on to the spray foil—has at least one structural composite foil, whereby the spray foil is applied in the places in which no structural composite foil is provided and/or the structural composite foil is damaged and/or slashed or cut out. Finally, it has been shown that from the installation standpoint, it is especially advantageous when the bulk of the surface to be supplied with a functional layer is supplied with a structural composite foil, thus, for example, a sarking, below-deck or façade membrane and/or an air and vapor trap/barrier, while the respective connection or detail points, which are difficult to connect, are covered by the spray foil. In principle, the spray foil here can have the same properties (e.g., sd value) as the structural composite foil. It can also be of quite special advantage, however, in this connection, when the spray foil has properties that are different from the structural composite foil, as can be the case, for example, in the area of rafters, which will be explained in greater detail below.

It is expressly pointed out that this invention is not limited to the application of a spray foil in the roof square. In principle, the invention can also be implemented in the area of the façade, when a corresponding framework is made there. In this case, the spray foil is applied on the outside of the sheathing on the inside of the building, which limits the frame field between two adjacent frames in the direction of the building. Below, only the special requirements in the area of the rafters and roof squares and the production of the spray foil at this location are discussed. The statements above and below apply, however, equally to the façade or the frameworks provided in the area of the façade.

The material of the spray foil is a plastic, which contains additives depending on the use and corresponding to the properties required for this purpose. As plastics, in principle any plastic material that can be applied by painting or spraying is suitable. Preferred in this connection are plastic dispersions, which can be dispersed, emulsified or dissolved in an aqueous or organic medium, preferably in an aqueous medium, 1K or 2K, polymerizates, polyamides, polyolefins, polystyrene, prepolymers and cross-linking agents, polysulfones, fluorinated polymers, polycarbonates, PVC, polyacrylonitrile, bitumen/bitumen copolymers, cellulose, latex, butadiene, styrene-butadiene, polyester, polyether, polyurethane, polyurethane resin, in this connection preferably acrylates and polyurethanes. The plastic content in the dispersion or in the solution is advantageously between 10 and 90% by weight, preferably 20 and 80% by weight, and especially preferably between 30 and 70% by weight. With use of prepolymers, the plastic content is >70%, preferably >85%, and more preferably >95%.

Moreover, the plastic contains additives. The additives that are contained are defined in particular as rheology modifiers, pH regulators, UV stabilizers, antioxidants, foam inhibitors, softeners, adhesion promoters, drying agents, dyes, pigments and leveling modifiers. Relative to the total amount of the spray foil in the dry state, the proportion of additives is up to 30% by weight, preferably 0.5-15%, and more preferably 1-7%.

In principle, the foam inhibitor additives of the group can be foam inhibitors that contain silicone or mineral oil. Silicone-containing foam inhibitors have turned out to be especially advantageous.

The proportion of foam inhibitors relative to the total amount of all components is between 0.1 and 10% by weight relative to the total amount of all components, in particular between 0.2 and 7.5% by weight. Those mixtures in which the foam inhibitor additive has a proportion of between 0.3 and 5% by weight are especially suitable.

Rheology additives are contained in general in an amount of 0.05 to 5% by weight and in particular 0.1 to 2.0% by weight, relative to the total amount of the spray foil in the wet state. For a spray application, rheology modifiers are preferred, which exert a strong thixotropic or structurally viscous effect in such a way that the viscosity of the spray foil or the spray foil material during the application, i.e., the action of high shearing forces, is low, but the viscosity at low shearing forces, i.e., after application, increases in such a way that a flowing-off of the sprayed layer does not take place.

Whether and which of the other additives, not described in more detail above, are worked into the spray foil depends on the type of planned use and the amount of other components contained. In general, the amount of this proportion is between 0 and 5% by weight.

Depending on the composition, the spray foil can be used not only in the previously mentioned fields of the structural composite foil. It is then also suitable even for use in the areas of flat roofs, sealing of ground-based components, and rain gutters. In addition, it can be used in studded and drainage membranes, garden structural foils, concrete, plaster, wood, non-woven fabric or similar materials for connections or repairs.

The amount of time saved when using a spray foil is all the greater the more demanding and geometrically complex the building structure detail is. Thus, e.g., the amount of time saved relative to the state of the art in the installation on a collar beam with a structural composite foil that is to be connected by adhesive tape is approximately 50%; the same savings is achieved with a binding piece.

The application temperature of the spray foil is between 5 and 50° C., preferably between 10° C. and 40° C. The film-forming time of the applied material is at most 2 hours, preferably 1 hour, and in particular between 5 and 30 minutes.

The applied layer thickness conforms to the respective requirements. In normal uses, between 4 and 800 μM is applied in the paint application, and between 11 and 1,500 μm is applied in the spray application. In the two applications, layer thicknesses of between 100 and 300 μm are preferably provided. In the sealing of ground-based components, higher requirements are necessary. In this area, layer thicknesses of 0.4-3 mm, preferably between 0.7-1.5 mm, are necessary.

To check the adhesion coefficients, the spray foil is applied to various bases, and after 24 hours, a T-peel test is performed according to DIN 4108. The adhesive strengths are >8 N/5 cm, preferably >12 N/5 cm, and more preferably >15 N/5 cm. In the application on a wet surface, at least 70% of the previously indicated values are achieved, preferably up to 85%, and sometimes more.

The water-tightness is determined according to EN 13859 as a static water column. For testing, the spray foil is applied on a 2 mm wide and 5 cm long crack in a foil base material. In this case, water-tightness of >100 mm, preferably >200 m, more preferably >500 mm, and in particular >1,000 mm, is achieved. In the sealing of ground-based components, higher requirements are also given here. There, water-tightness of >500 mm, preferably >1,500 mm, is necessary.

The water-tightness or water vapor permeability depends on the use and can be set as follows by the base material and the layer thickness depending on the application:

Use of the spray foil on/as air- and/or vapor trap/barrier: sd value according to EN 1931: 0.5-100 m, preferably 2-40 m, more preferably 2-5 m; and/or Use of the spray foil on/as moisture-variable air- and/or vapor trap/barrier: sd value according to EN 1931: <2 m in the moist range (relative humidity 90%) and >2 m in the dry range (relative humidity 40%), preferably <1.2 m in the moist range (relative humidity 90%), and >2.5 m in the dry range (relative humidity 40%); and/or Use of the spray foil on/as sealing in ground-based components: sd value according to EN 1931: >20 m, preferably >100 m, more preferably >200 m; and/or Use of the spray foil as a sarking, below-deck and/or façade membrane that is open to diffusion: sd value according to EN 1931: 0.01-0.5 m, preferably 0.02-0.3 m.

For the case that is open to diffusion, specifically incompatible foam-inhibiting additives can also be used, which result in pores caused by microfoam and thus in correspondingly low sd values.

The loop-shaped installation via the rafters represents a special use case. Generally speaking, a higher sd value is required in the area of the roof square, and a lower sd value is required in the area of the rafters themselves, in particular on the tops of the rafters. This can be achieved, e.g., in that the moisture-variable case is applied to the entire roof. The variant in which a vapor-barrier or vapor-trapping foil with a high sd value is placed in the roof square and the spray foil is applied to the rafters is preferred, however. In this case, a smaller sd value of the spray foil of <1.7 m, preferably <1 m, and more preferably <0.5 m, can be used.

Depending on the composition of the base and/or the width of the gap to be repaired, it is also possible to work with a support structure/layer. The latter is used to offset greater roughnesses and porosities or to span gaps. The support structure/layer can be, e.g., a non-woven fabric or cloth. In particular, light non-woven fabrics (10-50 g/m$^2$) made of polypropylene or polyester can be used, since the latter are inexpensive and flexible and offer a good base for coating with the spray foil.

Since components of a building are not covered immediately, but rather during the course of the construction progress, considerable exposure times to free weather conditions may result. UV exposure, heat, cold, wind and rain represent the main factors in this connection. Due regard is preferably paid to this in that the spray foil has sufficient resistance against UV radiation/heat and moisture swelling, is heat-resistant and cold-flexible, and offers appropriate tensile strength and elongations at break.

The resistance to UV radiation/heat is determined on a spray foil-film according to EN 13859 in a combination of artificial weathering (QUV, 14 days) and hot storage (80° C., 90 days). Subsequently, water-tightness, tensile strength and elongations at break are determined. At these values, in the spray foil according to the invention, 50%, preferably 80%, and more preferably 90% of the starting values are achieved before the weathering and hot storage.

The resistance to moisture swelling has been determined on a spray foil film according to the invention by storage in water at 50° C. for 4 weeks. Depending on the material of the spray foil, the weight increase is less than 20%, preferably less than 10%, and more preferably less than 5%. The tensile strength relative to the unsupported state is >30%, preferably >50%. If the test is performed on a substrate, separation must not be observed.

Cold flexibility has been determined on the spray foil film according to the invention with the respective largest layer thickness as cold-bending behavior according to EN 13859. The test is passed at −5° C., preferably at −15° C., and more preferably at −30° C.

The tensile strength according to EN 13859 of the spray foil has turned out to be adequate at a value of >50 N/5 cm. Values of >80 N/5 cm have preferably been achieved.

The elongation at break according to EN 0859 of the spray foil has proven suitable at a value of >50%. Values of >100% and also >200% were preferably achieved.

If, however, the spray foil is applied on a support structure, an elongation at break of >10%, preferably >20%, is adequate. In this case, the tensile strength should preferably be >100 N/5 cm.

For the suitability of the coating or the spray foil for practical use, the properties in liquid form are also important in addition to the properties of the hardened spray foil. In this case, the viscosity, the drying time, and the flow-off behavior of the material of the spray foil play a role by themselves or in combination.

For the paint application, the viscosity should be in the range of 5,000 to 25,000 mPa·s, preferably between 8,000 and 18,000 mPa·s, and more preferably between 11,000 and 15,000 mPa·s. For the spray application, viscosities of between 500 and 5,000 mPa·s are suitable, preferably between 1,000 and 4,000 mPa·s, and in particular between 1,500 and 3,000 mPa·s.

The drying time at 20° C. and 50% relative humidity is preferably <5 hours, so that a continuation of the procedure is possible within a reasonable period after applying the spray foil. The spray foil is then surface-dry and can withstand small loads. The drying time is preferably less than two hours and more preferably <1 hour, whereby an open time of >5 minutes, preferably between 6 and 20 minutes, can be useful to make corrections possible.

Drying times of the solvent-free film, i.e., the spray film on an aqueous basis, aside from temperature and atmospheric humidity, depend very greatly on the acrylate dispersions that are used. Here, it has been shown that formulations based on the revacryl series of synthomers have the best properties relative to drying time and film-forming, such as a comparison produced with formulations based on comparable acrylate dispersions—e.g., Primal AC 235 (Rohm & Haas) or Mowilith LDM 7739 (Celanese):

| Acrylate Dispersion | Manufacturer | Content [%] | Tg [° C.] |
|---|---|---|---|
| Primal AC 235 | Rohm & Haas | 46 | 5-10 |
| Mowilith LDM 7739 | Celanese | 48 | 7 |
| Revacryl 100 | Synthomer | 60 | 5-13 |

The comparison formulations were coated with a doctor knife adjacent to one another on the plastic foil (200 μm wet layer thickness), and the time until the film-forming was stable and could no longer be damaged, i.e., by exerting pressure with a blunt object, was determined:

| Stable Film-Forming [min] | | | |
|---|---|---|---|
| Temperature | AC 235 | LDM 7739 | Revacryl 100 |
| 11° C. | 50 | 50 | 23 |
| 13° C. | 38 | 45 | 16 |
| 15° C. | 33 | 38 | 13 |

An exemplary formulation for inside uses (below the thermal insulation), in which in winter, no below-zero temperatures act on the film of the spray foil, looks as follows:

Plastic dispersion Synthomer Revacryl 100, ventilator Tego Airex 902W 2.7%, BTC Helizarin Blue 3.3%, filler Quarzwerke Tremin Wollastonite USST 939-100 10%, filler Dupont Tipure $TiO_2$ 3.3%, thickener Borchi gel 0625 0.1%, thickener Borchi gel 0622 0.2%, foam inhibitor Tego Foamex 825 3.3%.

An exemplary formulation of outside uses (above the thermal insulation), in which in winter, below-zero temperatures act on the film of the spray foil, looks as follows:

Plastic dispersions Synthomer Revacryl 100: Synthomer Revacryl 5239 ratio 1:2, foam inhibitor Tego 590 LAE 15%, BTC Helizarin Blue 0.25%, Filler Quarzwerke Tremin Wollastonite USST 939-100 12.5%, thickener Borchi gel 0625 0.1%, thickener Borchi gel 0622 0.2%.

The flow-off behavior is especially important in sloped and vertical uses, whereby in principle, it can be pointed out that this invention can be easily implemented in horizontal uses, uses sloped at any angle, and vertical uses. Runs, which are also known by the names curtains or noses, can occur when materials are too thickly applied at low viscosity, specifically with applications on a vertical base. In connection with this invention, it has been determined that the flow-off behavior depends on, on the one hand, the viscosity of the material to be applied, and, on the other hand, the layer thickness. In addition, the surface tension of the base, on which the material of the spray foil is applied, plays a role. In principle, the viscosity and the layer thickness as well as the surface tension of the base should be selected in such a way that when applied on a vertical flat surface, a discharge width of less than 7 cm, preferably less than 5 cm, and in particular <3 cm is produced.

In a test that has been performed in connection with this invention, two drops of the liquid film with a viscosity corresponding to the above-mentioned ranges are to be applied to a film that is made of polyamide 6 with a surface tension of 42 mN/m. Then, the film has been placed vertically. The layer thickness of the drops was in the range of 1.5 mm here. The flow-off behavior or the length of the run was less than 3 cm.

Below, several formulation examples of the material of the spray foil according to the invention are indicated:

Formulation 1 (Spraying)

Plastic dispersion RA 576 H (acrylate/methacrylate base) of the Ercros Company, foam inhibitor Tego Foamex 805 1% from the Evonik Company, Printofix Red 0.5% from the Clariant Company, thickener Borchi gel 0621 0.5% from the OMG Borchers Company.

Viscosity: 1,750 mPa·s

Layer Thickness: 284 g/m$^2$

Sd Value: 1.95 m

Use, e.g.: U-shaped between the rafters or as vapor-barrier LDS/repairs

Formulation 2 (Painting)

Plastic dispersion Mowilith LDM 7739 (acrylate base) from the Celanese Company, foam inhibitor AF 0871 1% from the OMG Borchers Company, Printofix Yellow 0.5% from the Clariant Company, thickener Borchi gel 0621 0.1%, from the OMG Borchers Company, leveling additive Borchi gel 232 1% from the OMG Borchers Company Viscosity: 15,400 mPa·s Layer thickness: 197 g/m$^2$ Sd value: 0.92 m Use, e.g.: U-shaped between the rafters or as vapor-barrier LDS/repairs Formulation 3 (Painting)

Plastic dispersion Emuldur DS 2360 (polyurethane base) from the BASF

Company, foam inhibitor Tego Foamex 805, 0.8% from the Evonik Company, thickener Borchi gel 0621 0.15% from the OMG Borchers Company, leveling additive Borchi gel 232 1.2% from the OMG Borchers Company Viscosity: 10,300 mPa·s Layer thickness 1: 60 g/m$^2$ Sd value: 1: 0.05 m Layer thickness 2: 105 g/m$^2$ Sd value 2: 0.09 m Use, e.g.: as UDB that is open to diffusion, for repairs of UDB or on the rafters in combination with a U-vapor barrier Formulation 4 (Spraying)

Acrylate dispersion: RA 576 H from the Ercros Company

Foam inhibitor: AF 0871 1.25% from the OMG Borchers Company

Color: Printofix Red 0.5% from the Clariant Company

Thickener: Borchi gel 0621 0.5% from the OMG Borchers Company

Viscosity: 1,750 mPa·s

Layer thickness: 284 g/m$^2$

Sd value: 1.95 m

Use, e.g.: U-shaped between the rafters or as vapor-barrier LDS/repairs

Formulation 5 (Spraying)

Acrylate dispersion: Mowitith LDM 7739 from the Celanese Company

Foam inhibitor: AF 0871 1.5% from the OMG Borchers Company

Color: Printofix Red 1.0% from the Clariant Company

Color: Printofix Yellow 1.0% from the Clariant Company

Thickener: Borchi gel 0621 0.1% from the OMG Borchers Company

Leveling additive: Tego Wet 270 1% from the Evonik Company

Viscosity: 2,550 mPa·s

Layer thickness: 205 g/m2

Sd value: 2.3 m

Use, e.g.: U-shaped between the rafters or as vapor-barrier LDS/repairs

Formulation 6 (Spraying)

Plastic dispersion Emuldur DS 2361 (polyurethane base) from the BASF Company, foam inhibitor Tego Foamex 805 1.2% from the Evonik Company, thickener Borchi gel 0621 0.08% from the OMG Borchers Company, leveling additive Borchi gel 232 0.9% from the OMG Borchers Company Viscosity: 1,360 mPa·s Layer thickness: 66 g/m$^2$ Sd value: 0.19 m Use, e.g.: as UDB that is open to diffusion, for repairs on UDB, on the rafters in combination with U-vapor barrier, sealing of butt joints Formulation 7 (Painting)

Acrylate dispersion: Synthomer 100 from the Synthomer Company

Foam inhibitor: Tego 815 N 4% from the Evonik Company

Color: Printofix black 1.0% from the Clariant Company

Thickener: DSX 3800 0.2% from the Cognis Company

Viscosity: 11,700 mPa·s

Layer thickness: 123 g/m2

Sd value: 1.4 m

Use, e.g.: U-shaped between the rafters or as vapor-barrier LDS/repairs

The differences between the formulations for the variants that can be painted and sprayed essentially relate to the proportion of the rheology additive to the total amount of the spray foil in the wet state. For the variants that can be sprayed, higher proportions are necessary because of the greater applied layer thickness and the thus greater tendency to form runs. Relative to the indicated example, the proportion of the rheology additive is increased by approximately 50% relative to the original addition of the additive for the paint-on foil.

The application of the foil according to the invention can be done by spray application by airless devices, airmix devices, or spray nozzles. In airless application by a pressure spray bottle, in principle commercially available nozzles (hollow cone, full cone, or flat jet, etc.) can be used. Because of the high viscosity of the material of the spray foil, however, a special nozzle is preferably used. In the airmix application, the spray foil is poured into the color cup of the spray pistol and applied with compressed air. The spray nozzles preferably contain about 50% dimethyl ether as a propellant and approximately 50% spray foil material. In the spray application method, the distance to the surface to be sprayed is about 30 cm.

According to the invention, it is possible in principle that the functional layer is formed completely by the spray foil. It is also possible, however, that at least one air-tight and/or water-tight foil strip that runs along the roof square and is designed in particular as a vapor barrier is applied on the sheathing, whereby the longitudinal edges of the foil strip and the spray foil attached in front or in back then overlap. In this connection, it is preferred if first spray foil strips are applied to the sheathing, while the central area remains free for the foil strips. Subsequently, the foil strip is then overlapping on the applied spray foil, so that then a secure bonding of the foil strips via the spray foil to the sheathing is produced.

In an especially preferred embodiment of this invention, the spray foil is applied to at least one, in particular two, rafter sides of the rafters of a rafter box at least up to a partial height. In this case, a U shape of the functional layer is produced (relative to the cross-section). In this case, the spray foil is applied in such a way that only a closed surface of the spray foil and thus an air-tightness in the area of the spray foil is produced. This relates not only to the rafter sides and the outside of the sheathing, but also in particular to the transition between the sheathing and the rafters.

In connection with this invention, it has been found here that it is advantageous that the spray foil, starting from the sheathing, is applied over a rafter height of between 10 to 90%, preferably 20 to 80%, and in particular of over 30% to the rafter side. In this case, the sd value of the spray foil and/or the foil strip should be—at a relative humidity of 40%—more than 0.5 m, more preferably than 0.8 m, even more preferably than 1.3 m, and in particular more than 1.9 m.

To make possible as unimpeded a drying-out of the wood of the rafters as possible from the outside, the vapor-barrier spray foil, which is applied to the sheathing as a functional layer, should not be provided on the tops of the rafters. The tops of the rafters can either remain free or else an additional foil strip that is open to diffusion and/or another spray foil that is open to diffusion (i.e., by spraying or painting) is applied at least in some places. In this case, the sd value of the additional foil strip or the other foil should be smaller than 0.5 m, preferably smaller than 0.3 m, and in particular smaller than 0.09 m.

Although a connection between the additional foil strips provided on the top of the rafter or the additional foil with the lower spray foil is not absolutely necessary, nevertheless an excessive coating in this area, i.e., a cover in the edge area with a few centimeters, is preferably provided, since in this respect, the air-tightness can be better ensured.

After application of the lower spray foil, optionally in connection with a foil strip, as well as the additional spray foil or the additional foil strips provided on the tops of the rafters, the building shell is preferably further built up by corresponding materials. Thus, a thermal insulation material can first be applied one time to the foil, and said material is then introduced into the rafter box. Another sheathing, another thermal insulation layer, or a below-deck membrane that is open to diffusion can then follow. Another foil that is open to diffusion that is applied by spraying or painting or another separation point that is open to diffusion can also be provided.

Counter lathing and/or battens can then be applied if necessary to the above-mentioned layers, which can be provided by themselves but also in any combination with one another. The outside forms a hard, outer cover. In this connection, this can be a tiled roof or else a metal roof Moreover, it goes without saying that in the area of the façade, corresponding layers and materials can be provided, if this is desired and is necessary.

In addition, this invention, as mentioned above, also relates to a building shell, in which the previously mentioned features according to the method are then produced in a corresponding structural manner.

Below, moreover, features are indicated that by themselves or in any combination with one another and/or with the features indicated in the claims describe possible embodiments of the method according to the invention of the functional layer according to the invention and/or the building shell according to the invention, and are therefore also essential to the invention. Thus, the method, the building shell and/or the functional layer or the spray foil can be characterized in addition in that The viscosity of the material of the foil for a paint application is in the range of between 5,000 to 25,000 mPa·s, preferably between 8,000 and 18,000 mPa·s and more preferably between 11,000 and 15,000 mPa·s, and/or the viscosity for a spray application is between 500 and 5,000 mPa·s, preferably between 1,000 and 4,000 mPa·s, and more preferably between 1,500 and 3,000 mPa·s, and/or The drying time at 20° C. and 50% relative humidity is less than 5 hours, preferably less than 2 hours, and more preferably less than 1 hour, and/or the open time of the material of the foil after the application is greater than 5 minutes, in particular between 6 and 20 minutes, and/or The discharge width of the material of the foil applied to a vertical surface depending on the surface tension of the base, the viscosity and the thickness of the applied material is less than 10 cm, preferably less than 5 cm, and more preferably less than 3 cm, and/or The layer thickness of the film in the case of non ground-based uses in the paint application is between 4 and 800 μm and in the spray application is between 11 and 1,500 μm, preferably between 100 and 300 and/or The adhesive strength of the foil after 24 hours in a T-peel test according to DIN 4108 for dry underpressure is greater than 8 N/5 cm, preferably greater than 12 N/5 cm, and in particular greater than 15 N/5 cm, and preferably in the application on a moist surface, the adhesive strength corresponds to at least 70%, preferably about 85%, of the adhesive strength on the dry surface, and/or With the following uses, the foil has the following water vapor permeability:

Use as a vapor barrier: sd value according to EN 1931: 0.5 to 100 m, preferably 2 to 40 m, and in particular 2 to 5 m; and Use as a moisture-variable vapor barrier: sd value according to EN 1931: less than 2 m in the moist range (relative humidity 90%) and greater than 2 m in the dry range (relative humidity 40%), preferably less than 1.2 m in the moist range (relative humidity 90%) and greater than 2.5 m in the dry range (relative humidity 40%); and/or Use as a seal in the ground-based use: sd value according to EN 1931: greater than 20 m, preferably greater than 100 m, and in particular greater than 200 m; and/or Use as a layer that is open to diffusion: sd value according to EN 1931: 0.01 to 0.5 m, preferably 0.02 to 0.3 m.

As material of the foil, a one- or multi-component plastic is provided, in particular in the form of a plastic dispersion, which can be dispersed, emulsified or dissolved in the aqueous or organic medium, and/or The plastic is selected from polyamides, polyolefins, polystyrenes, prepolymers and cross-linking agents, polysulfones, fluorinated polymers, polycarbonates, PVC, polyacrylonitrile, bitumen/bitumen copolymers, cellulose, latex, butagene, styrene-butagene, polyester, polyether, polyurethane, acrylates, in each case by themselves or in any combination with one another, and/or The plastic content in the dispersion, emulsion or in the solution is between 10% by weight and 90% by weight, preferably between 80% by weight and 100% by weight, and in particular between 30% by weight and 70% by weight, and/or When using prepolymers, the plastic content is greater than 70%, preferably greater than 85%, and more preferably greater than 95%, and/or The plastic contains additives, and as additives, rheology modifiers, pH regulators, UV stabilizers, antioxidants, foam inhibitors, softeners, adhesion promoters, drying agents, dyes, pigments and/or leveling modifiers are provided, and/or The proportion of additives relative to the total amount of the material of the foil in the dry state is up to 30% by weight, preferably between 0.5 to 15%, and in particular between 1 to 7%, and/or As foam-inhibitor additives, silicone-containing and/or mineral oil-containing foam inhibitors are provided, and/or The proportion of foam inhibitor relative to the total amount of all components is between 0.1% by weight to 10% by weight, in particular between 0.2% by weight and 7.5% by weight, and especially preferably between 0.3% by weight and 5% by weight, and/or The rheology modifiers are contained in an amount of 0.05% by weight to 5% by weight and in particular 0.1% by weight to 2% by weight relative to the total amount of the foil in the wet state, and/or Those rheology modifiers are provided that exert a strong thixotropic or structurally viscous effect in such a way that the viscosity of the foil during the application is low, but the viscosity after the application increases in such a way that a flowing-off of the applied foil does not take place, and/or The application temperature of the foil is between 5° C. and 50° C., preferably between 10° C. and 40° C., and/or The skin-forming time of the foil is at most two hours, preferably one hour, and in particular between 5 minutes and 30 minutes, and/or The layer thickness of the foil in non-ground-based uses is between 4 and 800 μm in the paint application and between 11 and 1,500 μm, preferably between 100 and 300 μm, in the spray application, and/or The layer thickness of the foil in ground-based uses is between 0.4 to 3 mm, preferably between 0.7 and 1.5 mm, and/or The adhesive strength of the foil after 24 hours with a T-peel test according to DIN 4108 on a dry base is greater than 8 N/5 m, preferably greater than 12 N/5 cm, and in particular greater than 15 N/5 cm, and preferably, in the application on a moist surface, the adhesive strength corresponds to at least 70%, preferably 85%, of the adhesive strength on the dry surface, and/or The water-tightness (determined according to EN 13859 as a static water column) in the case of non-ground-based use is greater than 100 mm, preferably greater than 200 mm, more preferably greater than 500 mm, and in particular greater than 1,000 mm, and/or The water-tightness (determined according to EN 13859 as a static water column) in ground-based uses is greater than 500 mm and in particular greater than 1,500 mm, and/or The foil in uses that are open to diffusion has incompatible foam-inhibiting additives that result in microfoam-caused pores and low sd values, and/or The functional layer in the area of the foil has a support structure for bridging, and/or The support structure is designed as a cloth or non-woven fabric, in particular made of polypropylene or polyester, and/or The resistance of the foil according to (EN13859) after artificial weathering (QUV, 14 days) and hot storage (80° C., 90 days) is such that at least 50%, preferably more than 80%, and in particular more than 90% of the starting values are reached before the weathering and hot storage, and/or The weight increase of the foil in a storage in water at 50° C. for four weeks is less than 20%, preferably less than 10%, and in particular less than 5%, and/or The test of the cold-bending behavior of the foil according to EN 13895 has been passed at −5° C., preferably at −15° C., and in particular at −30° C., and/or The tensile strength of the foil according to EN 13859 is greater than 50 N/5 cm, in particular greater than 80 N/5 cm, and/or The elongation at break according to EN 13859 of the foil is greater than 50%, preferably greater than 100%, and in particular greater than 200%, and/or The elongation at break in the application of the foil on a support structure is greater than 10%, preferably greater than 20%, and/or the tensile strength in the application on the support structure is greater than 100 N/5 cm, and/or The foil for use in the roof area, in particular in the area of flat roofs, is provided for sealing ground-based components, rain gutters, studded and drainage membranes, garden structural foils, concrete, plaster, wood, non-woven fabric or similar materials for connections or repairs, and/or In the use of the functional layer in the roof area that has rafters, a vapor-barrier structural composite foil is provided in the roof square between the rafters, while the foil is provided on the rafters, and in particular the foil has an sd value of less than 1.7 m, preferably less than 1 m, and in particular less than 0.5 m, and/or The spray application of the foil by airless devices, airmix devices or spray nozzles is carried out, and/or Before the application of the foil, the structural composite foil is prepared during installation in such a way that the structural composite foil rests flat on the base, and/or The structural composite foil is folded adjacent to the area in which the foil is to be applied and is fastened with clips or nails on the base, and/or The structural composite foil is cut out in the area of a penetration point for a component of the building shell, and then in the connecting area, the component and the structural composite foil are applied overlapping on the foil, and/or The adjacent component and the structural composite foil are covered by the foil over a covering area of less than 10 cm, preferably between 3 and 7 cm.

It is expressly pointed out, moreover, that the above-mentioned area specifications and intervals also indicated in the claims all comprise intermediate ranges and intermediate intervals that are within the range or interval limits as well as all individual values, and the latter can be considered as essential to the invention even when the latter are not mentioned in detail.

Below, embodiments of the invention are explained in conjunction with the accompanying drawings. In this case, all features that are described and/or depicted form the subject of this invention by themselves or in any combination, regardless of how they are combined in the claims or how they are referenced.

DETAILED DESCRIPTION OF THE INVENTION

Figure 1:
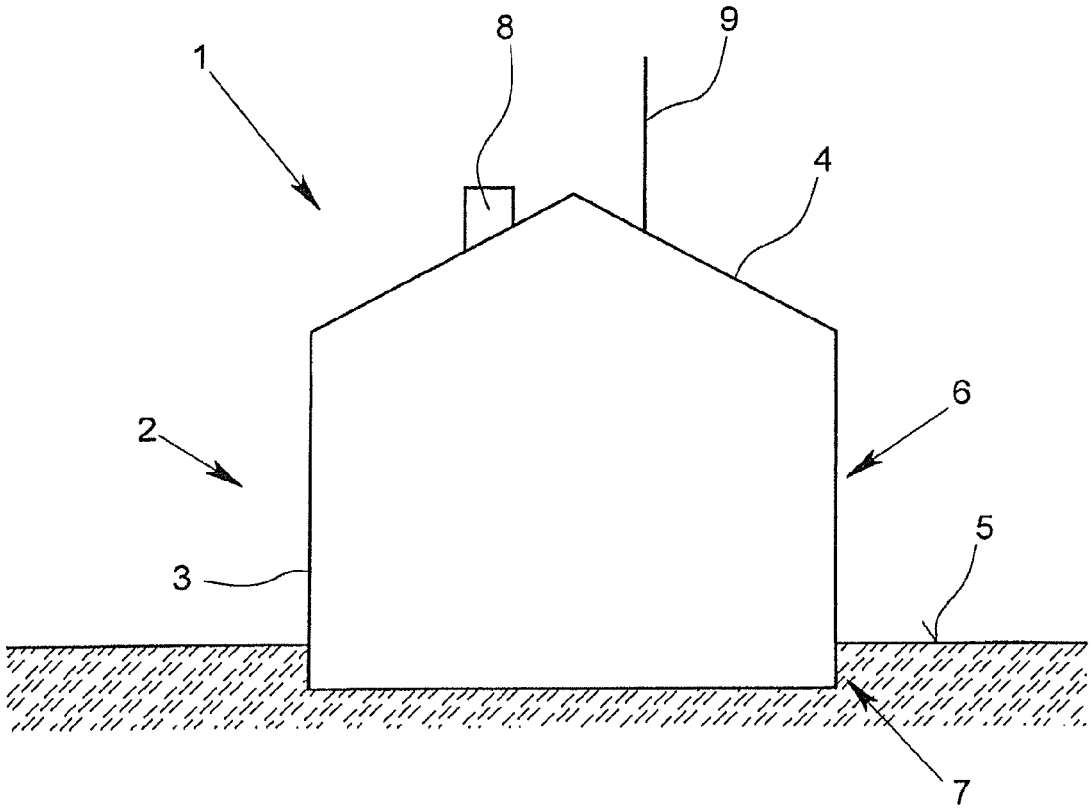
FIG. 1 is a diagrammatic representation of a building with a building shell.

In FIG. 1, a building 1 with a building shell 2, is depicted diagrammatically. The building shell 2 has a façade 3 and a roof 4. In this case, the façade 3 is divided into a non-ground-based façade area 6 that is located above the ground 5 and into a ground-based façade area 7 that is below the surface of the ground 5. In the area of the roof 4, a chimney 8 and an antenna 9 are present.

The building shell 2 is provided with a functional layer that is not shown in FIG. 1 and that can cover a full surface or a partial surface in the area of the façade 3 and/or the roof 4. In this case, it is understood that areas in which doors, windows or else the chimney 8 or the antenna 9 or else other details are located are excluded therefrom.

Figure 2:
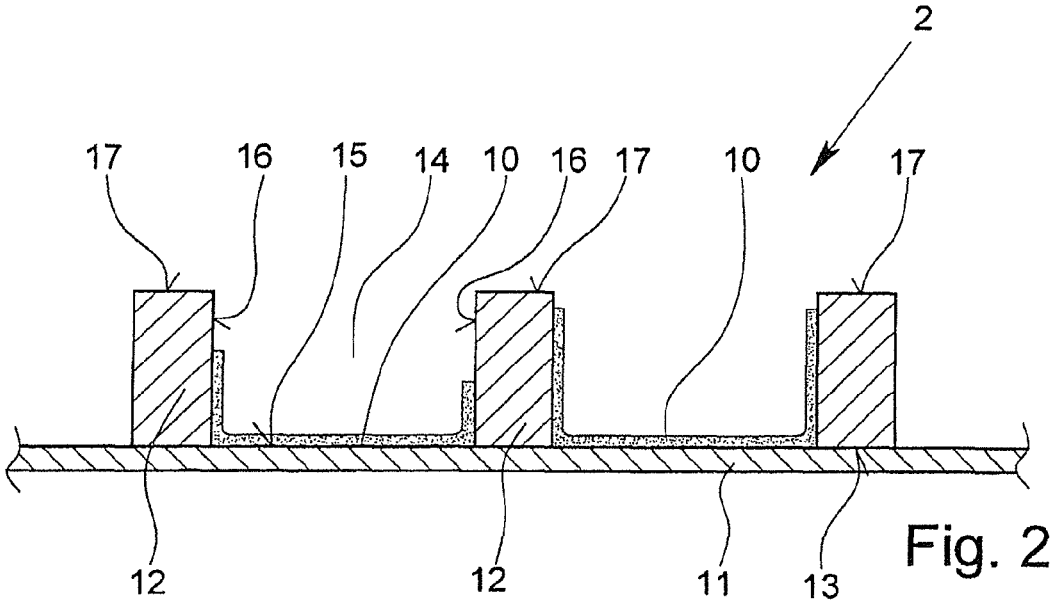
FIG. 2 is a cross-sectional view of a roof of a building shell according to the invention.
Figure 3:
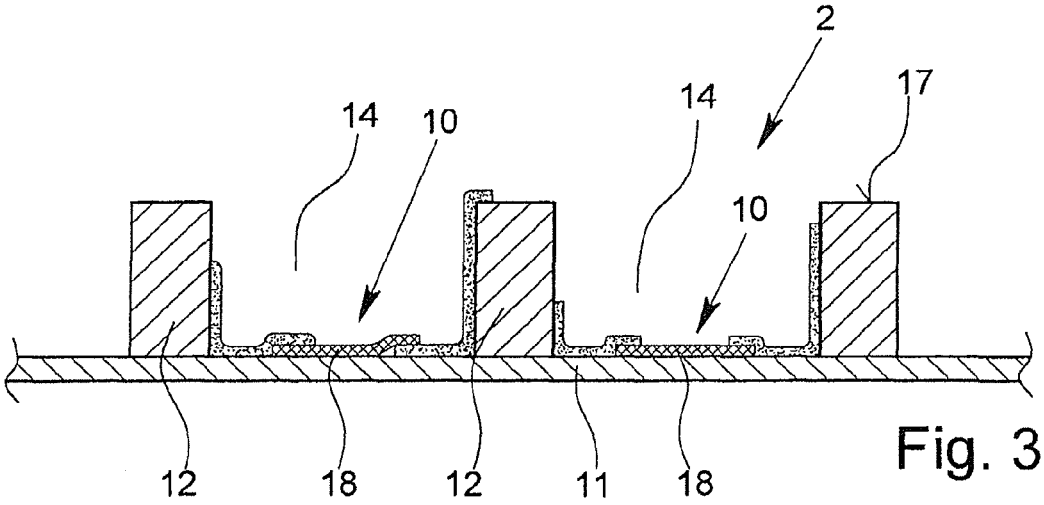
FIG. 3 is a view, corresponding to FIG. 2, of another embodiment of this invention.
Figure 4:
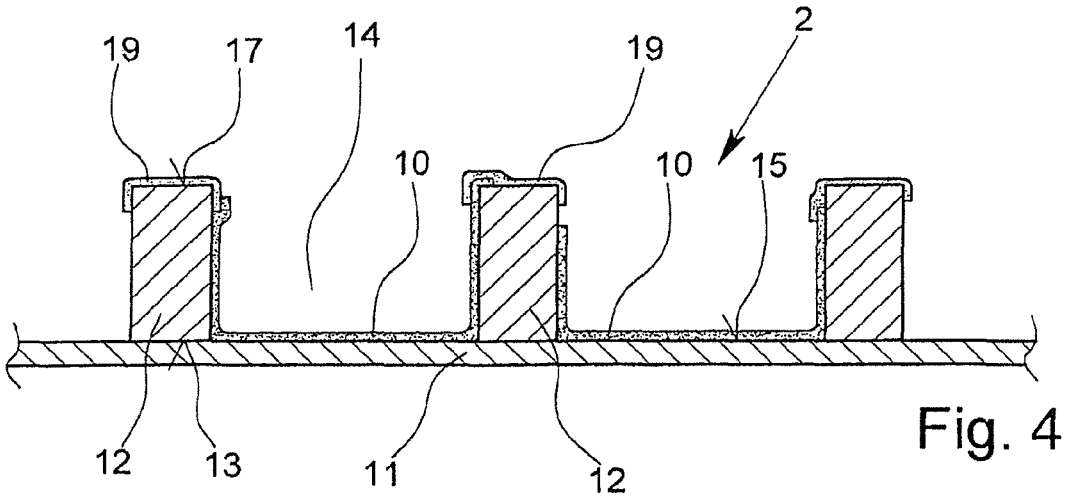
FIG. 4 is a view, corresponding to FIG. 3, of another embodiment of this invention.

In FIGS. 2 to 4, a part of a roof system of the building 1 is now depicted. The roof system in this case is also part of the building shell 2, which—in the roof area—has a sheathing 11 on the inside of the building and a large number of rafters 12. In this case, the sheathing 11 is arranged inside the building interior and is usually connected to the bottom sides 13 of various rafters 12. Between adjacent rafters 12, there are in each case roof bays 14 that are limited below by the sheathing 11. In the sheathing 11, any component can be made of any material, which seals off the roof bays 14 in the building interior. The outside 15 of the sheathing 11 points in this case toward the outside, i.e., away from the building interior.

In all embodiments shown, it is now such that the functional layer is applied to the outside 15 of the sheathing 11 at least in some places by painting and/or spraying a foil, which is referred to below as spray foil 10. After application, the spray foil 10 forms—i.e., after the sheathing 11 is applied on the outside 15—an air-tight and/or water-tight film, which preferably also has the properties of a vapor barrier.

In FIGS. 2 to 4, various possibilities for the design of the functional layer are depicted. In all embodiments, it is such that the functional layer extends not only over the entire width of the roof bay 14, but also is provided on the rafter sides 16. In this case, the functional layer extends respectively over a partial height of the rafter side 16. As is derived from the two roof bays 14 depicted in FIG. 2, the functional layer, which is formed completely from the spray foil 10 in this embodiment, can be extended only over a small part or else also almost completely over the entire rafter height. The top of the rafter 17 is uncoated in the embodiment according to FIG. 2, so that an unhindered drying-out of the wood is possible toward the outside.

In the embodiment according to FIG. 3, the functional layer has a foil strip 18 placed on the outside 15, whereby a strip of spray foil 10 is provided on the edge side at both edges. With the left roof bay 14 of FIG. 3, it is so that first the right spray foil 10 has been applied. Then, the foil strip 18 has been placed specifically in such a way that the foil strip 18 and the spray foil 10 overlap. Then, the left spray foil 10 has been applied, whereby here also an overlapping with the foil strip 18 takes place. Moreover, it is in the right spray foil strip such that the—even if only partially—projects on the top of the rafter 17. It is understood that the latter does not necessarily have to be the case. In the right rafter bay 14, in the embodiment according to FIG. 3, the foil strip 18 has first been applied to the outside 15 of the sheathing 11. Subsequently, the spray foil strips 10 have then been applied on the edge side. Also here, an overlapping of the spray foil 10 with the foil strip 18 is present.

In the embodiment according to FIG. 4, another spray foil 19 is found on the top of the rafter 17. In this case, it is in the left rafter 12 according to FIG. 4, so that the spray foil 19 has been applied first. Then, the spray foil 10 has been applied. The spray foil 10 and the other spray foil 19 overlap in the transition area. With the middle rafters 12 according to FIG. 4, it is such that first the spray foil 10 has been applied, specifically up to the top of the rafter 17. Subsequently, the additional spray foil 19 has been applied. In this case, an overlapping is produced on the left side, while this is not the case on the right side. There is even an uncoated gap there.

Instead of the additional spray foil 19, another foil strip can also be attached to the top of the rafter 17, which then has the same properties as the additional spray foil 19.

Figure 5:
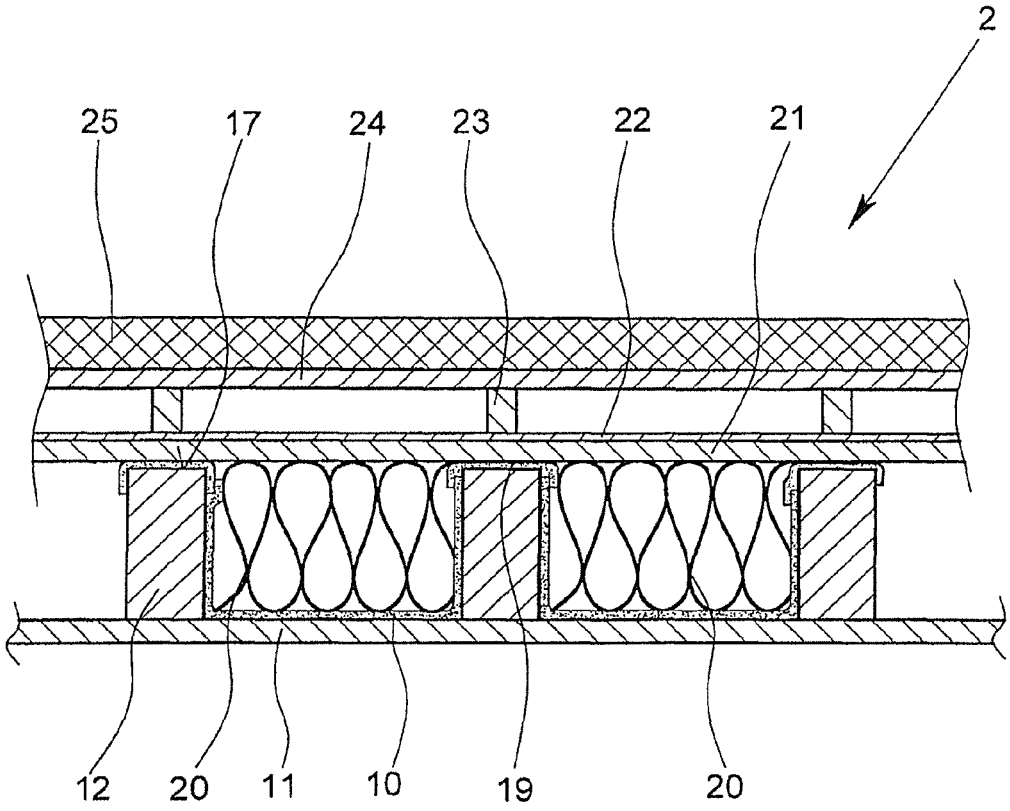
FIG. 5 is a diagrammatic cross-sectional view of a building shell in the roof area.

In FIG. 5, a roof system of a building shell 2 is depicted. In this case, the functional layer is applied as a spray foil 10 to the outside 15 of the sheathing 11, and the spray foil 10 is extended up to the rafter sides 16. The spray foil 10 is accordingly—seen in cross-section—U-shaped. Another spray foil 19 is attached to the top of the rafter 17. While the additional spray foil 19 is open to diffusion, the spray foil 10 is a vapor barrier. The spray foil 10 and the additional spray foil 9 thus have different sd values. A thermal insulation material 20 is introduced into the roof squares 14. Another sheathing 21, which only rests on the rafters 11 and is fastened thereto, is applied on the additional spray foil 19.

Above the additional sheathing 21, there is a below-deck membrane 22, which is present in a manner that is open to diffusion. Instead of the lower membrane 22, another spray foil with corresponding properties, i.e., present in a manner that is open to diffusion, can also be provided. Above the below-deck membrane 22, there is a counter lathing 23 and in turn battens 24. The roof shell is present formed by a hard cover 25 in the form of a tiled roof.

It is pointed out that FIG. 5 shows a possible embodiment of a roof system in a building shell 2 according to the invention. Thus, it is easily possible, for example, to provide rafter insulation or false edges above the rafters 12. In principle, the additional sheathing could be eliminated. Instead of a hard cover in the form of a tiled roof, moreover, a metal roof could also be provided.

It is pointed out that the embodiments depicted in FIGS. 2 to 5 can also be implemented in principle in the area of the façade in a framework. This invention thus is not limited to the roof area but rather also extends in particular to the façade area, whereby then instead of rafters, frames are provided.

In the embodiments depicted in FIGS. 6 to 20, it is such that the functional layer of the building shell 2, which ultimately at least essentially is not outside of the building shell 2, has a foil that is applied by spraying or painted at least in some places, and said foil forms an air-tight and/or water-tight film after application. The above-mentioned foil that is applied by spraying and/or painting is referred to below as a spray foil 10, without in this case being limited to the application by spraying.

In connection with FIG. 1, reference is made to the fact that the spray foil 10 can in principle be provided on the full surface over the entire area of the building shell 1, i.e., on the façade 3 and in the area of the roof 4. In this case, the spray foil forms the functional layer. The same applies when the spray foil is applied only in some places, thus not on the full surface. In the embodiments described below, it is such that the functional layer has a structural composite foil 112 in addition to the spray foil 10. In this case, structural composite foil ultimately is defined as a foil layer that can be formed of one or more membranes. Moreover, the term "structural composite foil" includes foils for protection from external factors, in particular sarking, below-deck and façade membranes, as well as membranes for protection against internal factors, in particular air and vapor traps/barriers. When the term "structural composite foil" is used below, in principle, any of the above-mentioned membranes thus can be meant.

In a combination of a spray foil 10 with a structural composite foil 112, it is suggested in particular to cover areas above the structural composite foil 112 that are large-surface and easy to install, while in those areas where the installation of the structural composite foil is difficult or impossible for connection reasons, the structural composite foil is damaged or is slashed or cut out in the connection of components, the spray foil 10 is applied.

Figure 6:
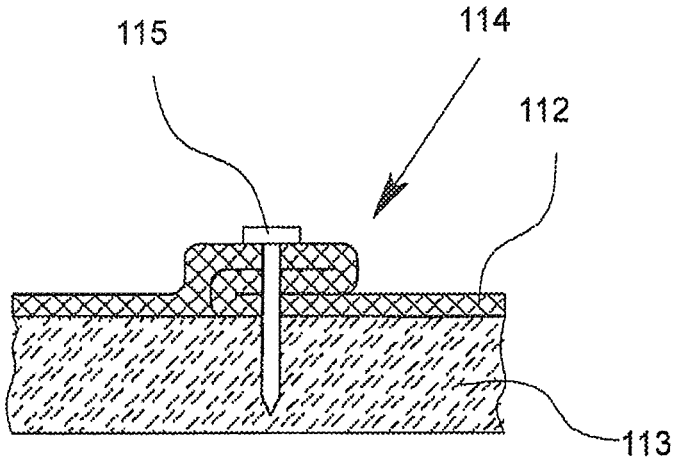
FIG. 6 is a diagrammatic cross-sectional view of a first installation position.

In FIG. 6, an installation position is depicted, which shows that the structural composite foil 112, during installation around a connecting detail, is prepared in the area of the detail in such a way that the structural composite foil 112 lies flat on the base 113. To this end, the structural composite foil 112 in the detail is folded in the directly adjacent area or provided with a fold 114 and fastened with nails 115 or else clips, not shown, on the base 113. After establishing an ensured flatness of the structural composite foil 112, the spray foil 10 can then be applied in the connecting detail area.

Figure 7:
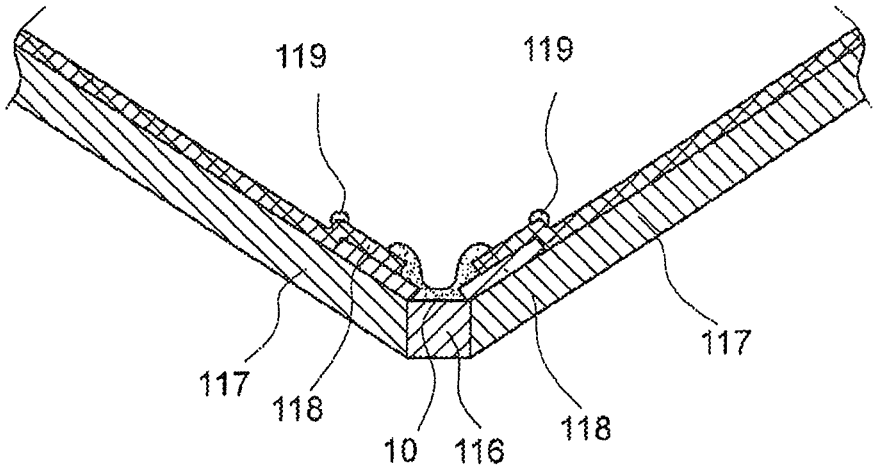
FIG. 7 is a diagrammatic view of a second installation position.

In FIG. 7, an installation position is depicted in which a valley 116 of the roof rafter 117 having a collar sheathing 118, and a structural composite foil 112. In the areas 119 in the changeover to the collar sheathing 118, slight damage of the functional layer can occur by stressing the structural composite foil 112. If, when installing the structural composite foil 112 in the areas 119, there is damage to the functional layer, this damage can be quickly repaired by a spray foil 10, which is applied to this area and forms a secure, adhesive film. Moreover, in the embodiment that is depicted, it is such that the structural composite foils 112 that strike one another from the two sides of the collar can be easily connected to one another by the applied spray foil 10.

Figure 8:
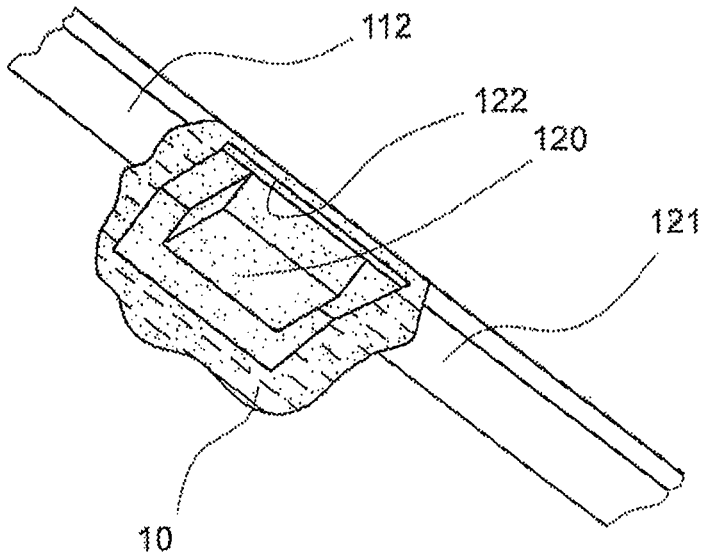
FIG. 8 is a diagrammatic view of a third installation position.

In FIG. 8, an installation position with a collar beam 120 and a roof rafter 121 is depicted. The structural composite foil 112 is cut out in the area of the collar beam 120, namely around the latter, in such a way that an opening 122 is produced. Then, the area of the opening 122 and the adjoining area of the structural composite foil 112 is provided with a spray foil 10, so that a closed functional layer 10 is produced.

Figure 9:
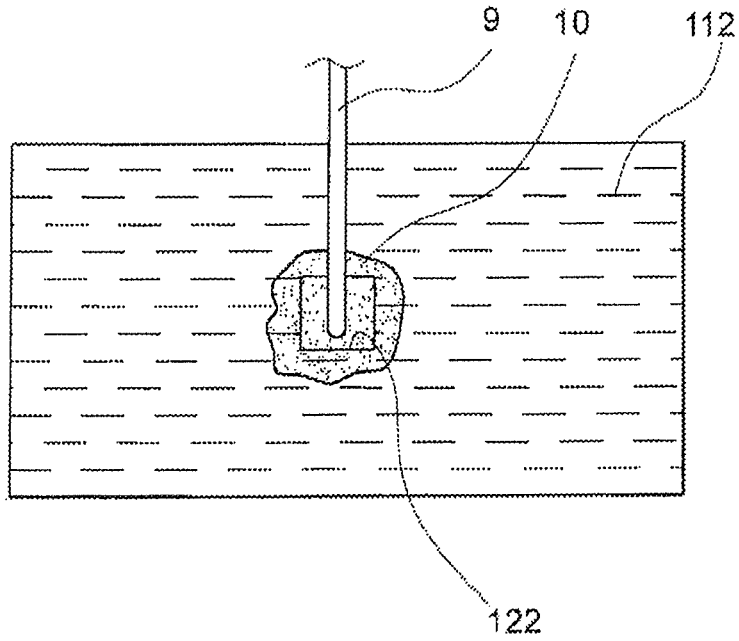
FIG. 9 is a diagrammatic view of a fourth installation position.

In FIG. 9, an installation position is depicted in connection with an antenna 9. It is pointed out that instead of the antenna 9, in principle a pipe or an aerator could also be provided in addition or instead.

The structural composite foil 112 is cut out in the penetration area of the antenna 9, so that the opening 122 is produced. Then, the opening area as well as the directly adjacent area of the structural composite foil 112 is provided with a spray foil 10 in such a way that, then, an air-tight and water-tight connection, and thus, a correspondingly tight functional layer 10 are produced.

Figure 10:
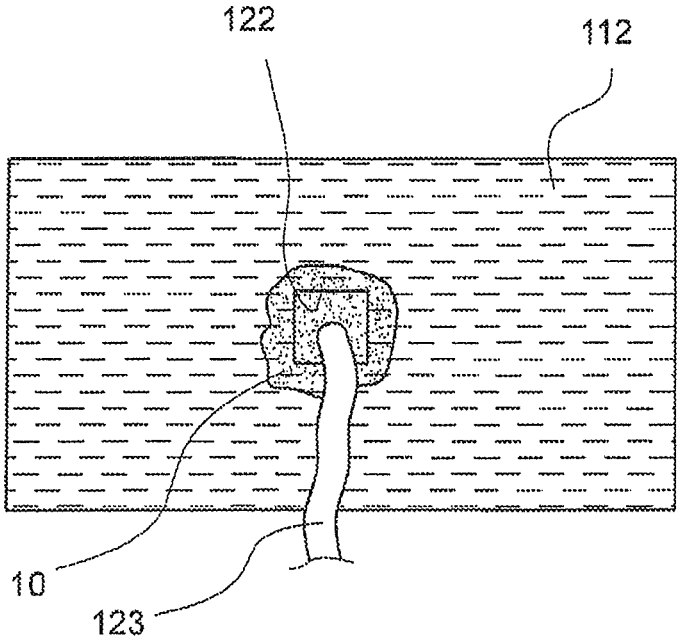
FIG. 10 is a diagrammatic view of a fifth installation position.

FIG. 10 shows an installation or connection position that is comparable to FIG. 9, wherein a cable 123 is provided instead of the antenna 9. Otherwise, the configurations are the same as indicated above.

Figure 11:
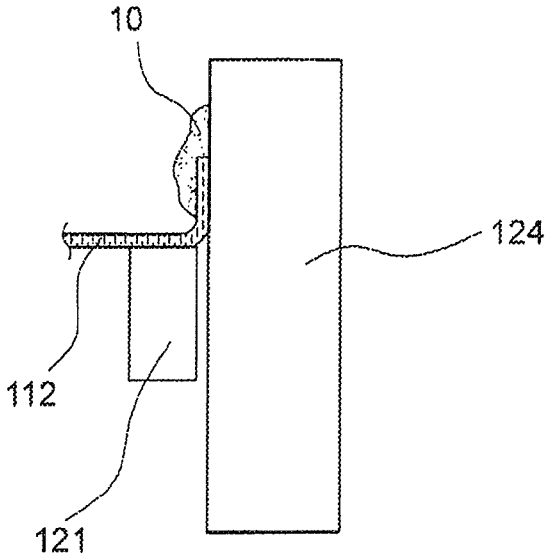
FIG. 11 is a diagrammatic view of a sixth installation position.

In FIG. 11, an installation position is depicted in which the connection to a wall 124 is shown. The wall connection is ultimately representative of rising components. Instead of the wall 124, other rising components can thus also be provided. Adjacent to the wall 124, there is a roof rafter 121, to which a structural composite foil 112 is attached. On the end side, the structural composite foil 112 is laid flat in the direction to the wall 124. The connection of the structural composite foil 112 to the wall 124 is made via the spray foil 10, which is attached on the edge side to the structural composite foil 112 as well as to the adjoining wall area. As a result, ultimately the air-tightness and water-tightness of the functional layer are produced.

Figure 12:
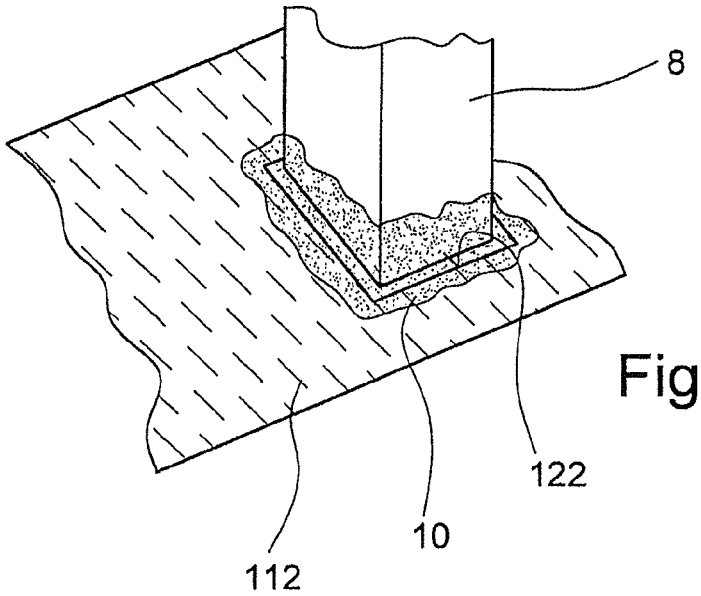
FIG. 12 is a diagrammatic view of a seventh installation position.

FIG. 12 shows a connection position for a chimney 8. In this case, the structural composite foil 112 is cut out in the area of the chimney 8 in such a way that the opening 122 is produced. Then, the connection via the spray foil 10 is carried out, which then—as also in the other embodiments—overlaps the structural composite foil 112, on the one hand, and the chimney 8 in the connection area, on the other hand. In this case, the overlapping should preferably be greater than 2 cm, preferably greater than 5 cm, and in particular should lie in the range between 7 cm and 15 cm. It is pointed out, moreover, that the chimney connection depicted in FIG. 12 can be considered as only representative of comparable connections, such as windows, in particular house skylights, as well as skylights per se.

Figure 13:
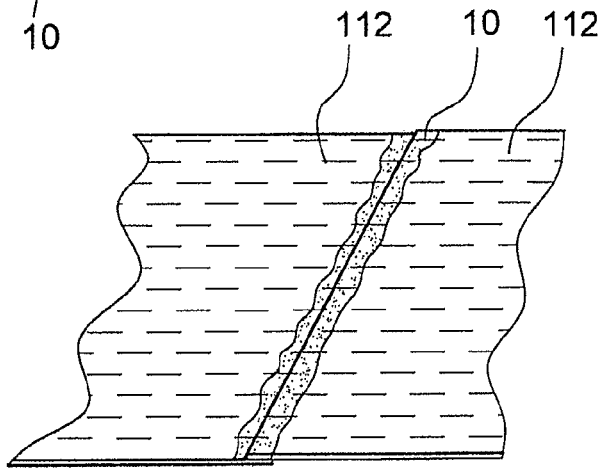
FIG. 13 is a diagrammatic view of an eighth installation position.
Figure 14:
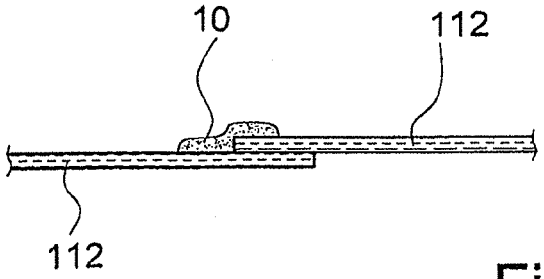
FIG. 14 is a side view of the installation position of FIG. 13.

FIGS. 13 & 14 show a fastening position, in which two structural composite foils 112, which overlap, are connected to one another via a spray foil 10. Ultimately, the front splicing of the structural composite foils 112, which overlap, are glued by the spray foil 10 and sealed. It is understood that the embodiment depicted in FIGS. 13 & 14 can be used not only in the area of the front splicing, but also on the longitudinal splicing or longitudinal edges of structural composite foils 112.

It is again pointed out that the above-mentioned installation positions depict only representative uses. It is understood that the spray foil 15 can be provided in principle at all sites that are difficult to access, whereby the spray foil 10 then is correspondingly matched by its properties to the construction requirements.

Figure 15:
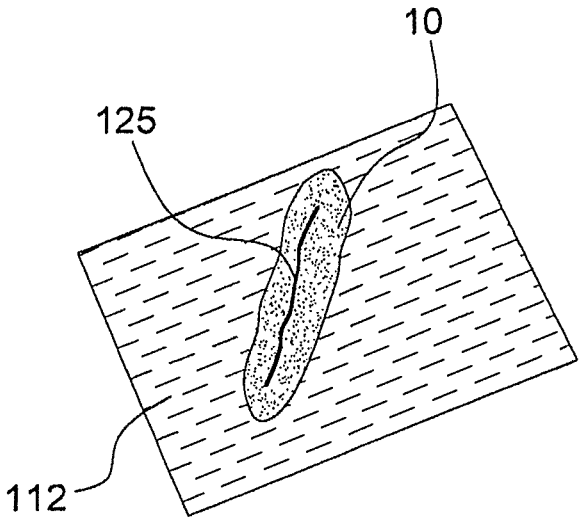
FIG. 15 is a diagrammatic view of a ninth installation position.
Figure 16:
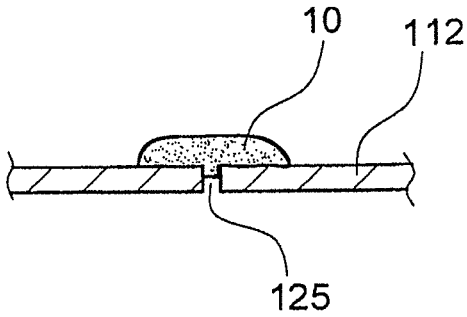
FIG. 16 is a side view of the installation position of FIG. 15.

The embodiments depicted in FIGS. 15 to 20, ultimately, relate to repair uses. In FIG. 15, a situation is depicted in which a crack 125 is found in the structural composite foil 112. Cracks of the type in question usually have a width of less than 3 mm, preferably less than 2 mm, and in particular less than 1 mm. Such cracks can be of any length. Cracks of this type can be repaired quickly and easily by application of the spray foil 10 for achieving the air-tightness and water-tightness.

Figure 17:
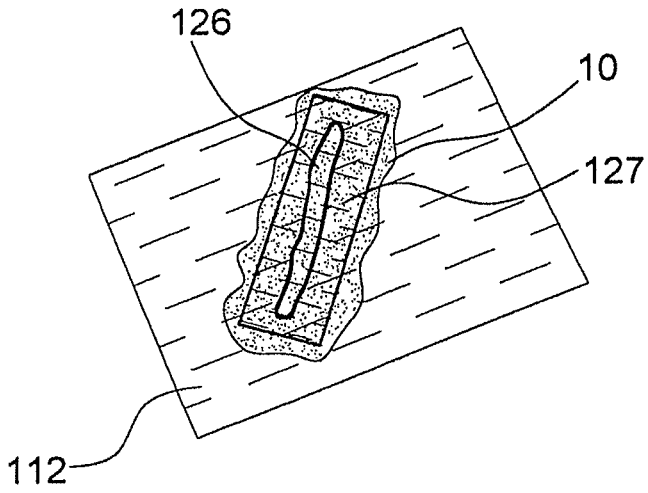
FIG. 17 is a diagrammatic view of a tenth installation position.
Figure 18:
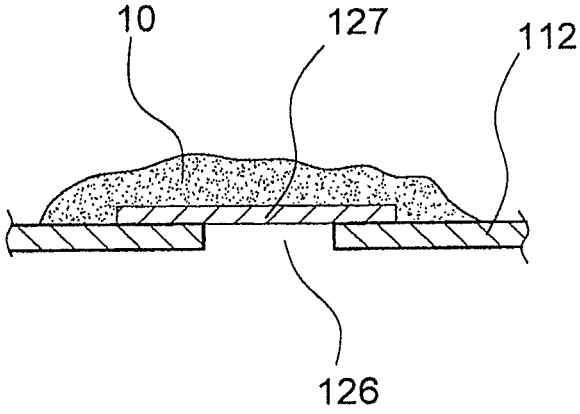
FIG. 18 is a side view of the installation position of FIG. 17.

In the embodiment depicted in FIGS. 17 & 18, a gap 126 is diagrammatically depicted as a defect in the structural composite foil 112. The gap 126 usually has a gap width of between 3 mm to 20 mm, preferably between 3 mm and 10 mm. To bridge the defect, a support structure 127, present in the form of a nonwoven fabric, is provided. The nonwoven fabric can have a surface weight of between 10 and 80 g/m$^2$, preferably between 10 and 50 g/m$^2$, and in particular between 10 and 30 g/m$^2$. The spray foil 10 is applied over the support structure 127, which then also adheres to the surrounding area of the structural composite foil and ensures a tight functional layer 10.

Figure 19:
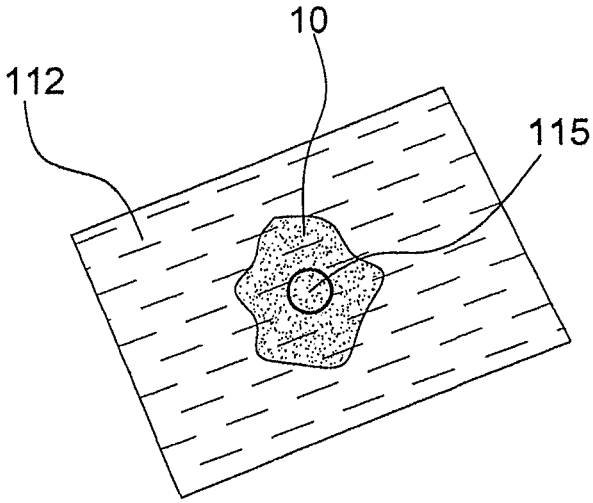
FIG. 19 is a diagrammatic view of an eleventh installation position.
Figure 20:
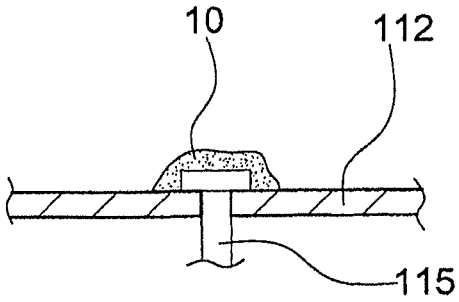
FIG. 20 is a side view of the installation position of FIG. 19, and FIGS. 21-24 are tables with properties of the spray foil according to the invention.

Finally, FIGS. 19 & 20 show a comparatively simple embodiment in which so-called nail or stapler points—at which the nail 115, clips or the same fastening agents are driven through the structural composite foil 112—are correspondingly sealed by the spray foil 10. In this case, it is understood that, for example, in the embodiment according to FIG. 6, a corresponding sealing can also be provided in the area of the nail 115.

In all above-mentioned embodiments, in which the application of the spray foil 10 is carried out by spraying, it is such that the spraying task can be carried out by various devices. In this connection, for example, these can be so-called airless devices, airmix devices and spray nozzles. In this case, the distance from the nozzle or outlet opening of the respective device should be about 30 cm to the surface to be sprayed.

Various embodiments of the spray or liquid foil according to the invention were tested in a laboratory test on various relevant properties with respect to suitability as a vapor barrier. The results are depicted in Tables 1a, 1b, 2a and 2b according to FIGS. 21 to 24. Based on five samples with sizes that can be seen in Tables 1a and 1b, i.a., the water vapor diffusion equivalent air layer thickness $s_d$ and the water vapor diffusion resistance number μ were determined, which in each case yields information on suitability as a vapor barrier. The two measurement series were recorded under different climatic conditions. The results show that for an optimal vapor barrier, whose action depends on the thickness thereof, a (wet) layer of 100 to 1,000 g/N$^2$ can be applied, whereby in the hardened state, the surface mass of the foil is 80 to 500 g/N$^2$. This corresponds to a film thickness of approximately 80 to 500 μm.

What is claimed is:

1. Functional layer of a building shell, comprising at least one film that has been applied to some parts of the building shell by at least one of spraying and painting, the film forming at least one of an air-tight and a water-tight vapor barrier film, wherein the film has been formed from a plastic material in the form of an aqueous plastic dispersion that has a content of a plastic material between 10 and 90% by weight, wherein the plastic material contains at least one rheology modifier in an amount of 0.05 to 5% by weight, relative to the total amount of the film in a wet state, a foam inhibitor in an amount of in between 0.1 and 10% relative to the total amount of all components, and additives in an amount up to 30% by weight, relative to the total amount of the film in a dry state, wherein the film has a tensile strength according to EN 13859 that is greater than 50 N/5 cm, wherein the film has an adhesive strength after 24 hours is greater than 8 N/5 m as determined by a T-peel test according to DIN 4108 on a dry base, and on a moist surface, the adhesive strength corresponds to at least 70% of the adhesive strength on the dry base and wherein the water-tightness determined according to EN 13859 as a static water column is greater than 100 mm.

2. Functional layer according to claim 1, further comprises an additional film that is open to diffusion and that has been applied by painting or spraying.

3. Functional layer according to claim 1, wherein the plastic dispersion has a plastic content comprised of at least 70% prepolymers.

4. A building shell, comprising: a facade, a roof, and a functional layer covering at least a partial surface in an area of at least one of the facade and the roof, wherein the functional layer comprises at least one film that has been applied by at least one of spraying and painting so as to form at least one of an air-tight and a water-tight vapor barrier film on said area;

wherein the film has been formed from a plastic material in the form of an aqueous plastic dispersion that has a content of a plastic material between 10 and 90% by weight, wherein the plastic material contains at least one rheology modifier in an amount of 0.05 to 5% by weight, relative to the total amount of the film in a wet state, a foam inhibitor in an amount of in between 0.1 and 10% relative to the total amount of all components, and additives in an amount up to 30% by weight, relative to the total amount of the film in a dry state, wherein the film has a tensile strength according to EN 13859 that is greater than 50 N/5 cm, wherein the film has an adhesive strength after 24 hours is greater than 8 N/5 m as determined by a T-peel test according to DIN 4108 on a dry base, and on a moist surface, the adhesive strength corresponds to at least 70% of the adhesive strength on the dry base and wherein the water-tightness determined according to EN 13859 as a static water column is greater than 100 mm.

5. Building shell according to claim 4, further comprising a film layer that is open to diffusion and that has been applied by painting or spraying.

6. Building shell according to claim 5, wherein said film layer has been applied at least in some places on rafters of the roof, the film partially overlapping said vapor barrier film in an area of the rafters.

* * * * *